US005181825A

United States Patent [19]

Sugitani et al.

[11] Patent Number: 5,181,825

[45] Date of Patent: Jan. 26, 1993

[54] METHOD FOR LIFTING AND GUIDING ELEMENTS ON BUILDING SITE

[75] Inventors: Yoshihisa Sugitani, Osaka; Isamu Matsubara, Toyama, both of Japan

[73] Assignee: Yoshida Kogyo K.K., Tokyo, Japan

[21] Appl. No.: 774,726

[22] Filed: Oct. 7, 1991

Related U.S. Application Data

[63] Continuation of Ser. No. 642,135, Jan. 15, 1991, abandoned, which is a continuation of Ser. No. 440,253, Nov. 22, 1989, abandoned.

[30] Foreign Application Priority Data

Nov. 28, 1988 [JP] Japan ..... 63-298052

[51] Int. Cl.[5] ..... E04G 21/14

[52] U.S. Cl. ..... 414/786; 52/125.1; 52/125.2; 187/2; 269/904; 414/11

[58] Field of Search ..... 52/122.1, 125.1, 125.2, 52/125.4; 187/2; 269/904; 414/11, 786

[56] References Cited

U.S. PATENT DOCUMENTS

| | | | |
|---|---|---|---|
| 2,499,498 | 3/1950 | Hammond, Jr. | 52/125.2 X |
| 3,863,418 | 2/1975 | Faucheux | 52/125.1 X |
| 3,880,258 | 4/1975 | Rompa | 187/2 |
| 4,022,330 | 5/1977 | Shannon, Jr. | 187/2 X |
| 4,591,308 | 5/1986 | Imai | 414/11 |

FOREIGN PATENT DOCUMENTS

| | | |
|---|---|---|
| 60-30743 | 2/1985 | Japan . |
| 1536486 | 12/1978 | United Kingdom . |

*Primary Examiner*—Michael S. Huppert
*Assistant Examiner*—Janice Krizek
*Attorney, Agent, or Firm*—Hill, Steadman & Simpson

[57] ABSTRACT

In a method for mounting panel elements (B), wherein an upper (5) and a lower (6) lateral lever are mounted to an exterior wall (A) of a building so as to correspond to each of the panel elements (B); an upper (1) and a lower (6) hook are mounted on a back surface of each of the panel elements (B), the upper hook (1) being engaged with the upper lateral lever (56), the lower hook (2) being engaged with the lower lateral lever (6); and the panel elements (B) are sequentially mounted on the exterior wall (A) upward from the bottom of the same in such manner as to permit the upper (1) and the lower (2) hook to engage the upper (5) and the lower (6) lateral lever, respectively, the improvement comprises: lifting the panel elements (B) by a lifting-guide unit (40); and employing joint spaces (29) for guiding the unit (40) in a lifting operation of the panel elements (b), the joint spaces (29) being formed between the panel elements (b) having been mounted on the exterior wall (A) of the building.

2 Claims, 9 Drawing Sheets

METHOD FOR LIFTING AND GUIDING ELEMENTS ON BUILDING SITE

This is a continuation of application Ser. No. 642,135 filed Jan. 15, 1991, abandoned, which is a continuation of application Ser. No. 440,253 filed Nov. 22, 1989, abandoned.

BACKGROUND OF THE INVENTION

1. Field of the Invention

The present invention relates to a method and apparatus for lifting and guiding a plurality of panel elements on a building site of a building along an exterior wall of the building during a mounting operation of the panel elements, which apparatus vertically travels on the exterior wall of the building to serve as a lifting-guide unit for the panel elements in their mounting operation on the exterior wall of the building.

2. Description of the Prior Art

When exterior walls of buildings get old with their appearance deteriorated, panel elements are often mounted on the exterior walls of the buildings to renew their appearance.

Hitherto, when the panel elements are mounted on the exterior wall of the building to renew its appearance, a suitable scaffolding is put up around the exterior wall of the building to enable building workers to mount the panel elements on the exterior wall of the building.

On the other hand, for example, Japanese Patent Laid-Open No. 60-30743 discloses a method for mounting a plurality of curtain wall units constituting a unit curtain wall on a building body.

In the method disclosed in the Japanese Patent Laid-Open No. 60-30743, a guide rail is formed in a longitudinal member of the curtain wall unit having been mounted on the building body to enable a lifting-guide unit to vertically travel on the guide rail. Then, a new curtain wall unit to be mounted on the building is connected to the lifting-guide unit, and lifted by the lifting-guide unit along the exterior wall of the building so as to be mounted on a desired portion of the exterior wall.

However, the method for mounting the panel elements on the exterior wall of the building by employing the scaffolding put up around the building is disadvantageous in that the building workers must conduct very cumbersome work to put up the scaffolding. In addition, there is a danger that the building workers may fall off of the scaffolding.

On the other hand, the method for mounting the panel elements on the exterior wall of the building according to the method for mounting the curtain wall units on the building body has disadvantages in that the guide rail must be formed on the building site. In addition, the panel elements employed in the method are restricted in shape to special ones to make it impossible to employ flat-shaped panel elements. Furthermore, since the panel element employed in the method is provided with the guide rail, the building covered with such panel elements is unattractive.

SUMMARY OF THE INVENTION

It is an object of the present invention to provide a method and apparatus for lifting and guiding a plurality of panel elements along an exterior wall of a building during a mounting operation of the panel elements, which apparatus vertically travels on the exterior wall of the building to serve as a lifting-guide unit for the panel elements in their mounting operation on the exterior wall of the building.

According to the present invention, the above object of the present invention is accomplished by providing:

In a method for mounting a plurality of panel elements on an exterior wall of a building, wherein an upper and a lower lateral lever are mounted on the exterior wall of the building so as to correspond to each of the panel elements; an upper and a lower hook are mounted on a back surface of each of the panel elements, the upper hook being engaged with the upper lateral lever, the lower hook being engaged with the lower lateral lever; and the panel elements are sequentially mounted on the exterior wall of the building upward from the bottom of the exterior wall in such a manner as to permit the upper and the lower hook of each of said panel elements to engage the upper and the lower lateral lever of the exterior wall of the building, respectively, the improvement which comprises:

lifting the panel elements by a lifting-guide unit; and employing joint spaces as means for guiding the lifting-guide unit during the lifting step for the panel elements, the joint spaces being formed between the panel elements which have been mounted on the exterior wall of the building.

The above object of the present invention is also accomplished by providing:

a lifting-guide unit for lifting and guiding a plurality of panel elements during a mounting operation thereof on an exterior wall of a building, comprising:

a main-body provided with a panel-element supporting portion and a right and a left guide portion;

a lifting roller rotatably mounted on the guide portion of the main body, the lifting roller being brought into contact with a front surface of each of the panel elements mounted on the exterior wall of the building while being rotatably driven over the front surface of each of the panel elements; and a pilot roller rotatably received in a joint space formed between the panel elements.

Since the present invention has the above construction, it is possible for the present invention to lift and guide the lifting-guide unit along the joint space formed between the panel elements which have been mounted on the exterior wall of the building, whereby a panel element to be mounted on the exterior wall of the building is lifted and guided to its mounting area of the exterior wall of the building by use of the lifting-guide unit.

DESCRIPTION OF THE PREFERRED EMBODIMENTS

Figure 1:
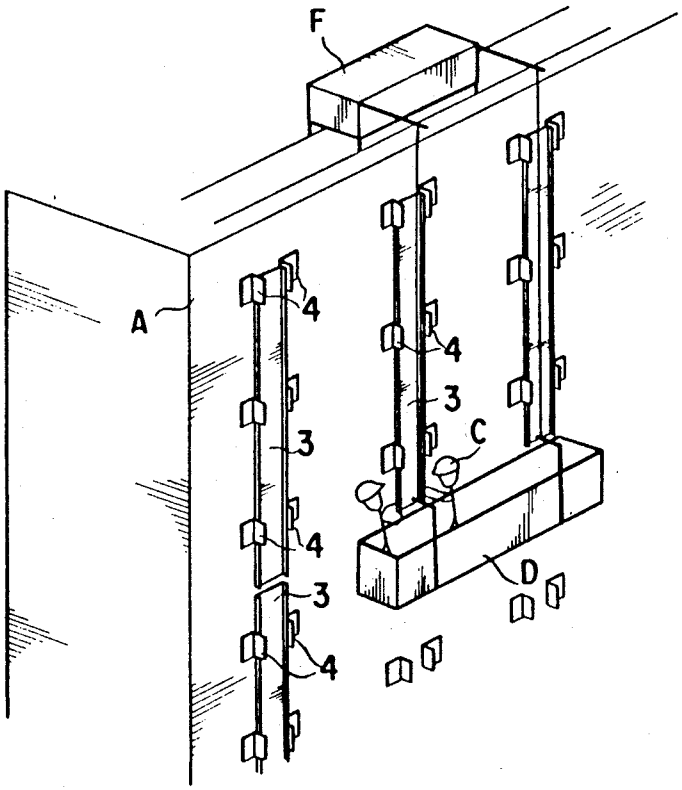
FIGS. 1 (*a*)-(*f*) are schematic views of an embodiment of the present invention, sequentially illustrating steps of the method for lifting and guiding the panel element being mounted on the exterior wall of the building.
Figure 1:
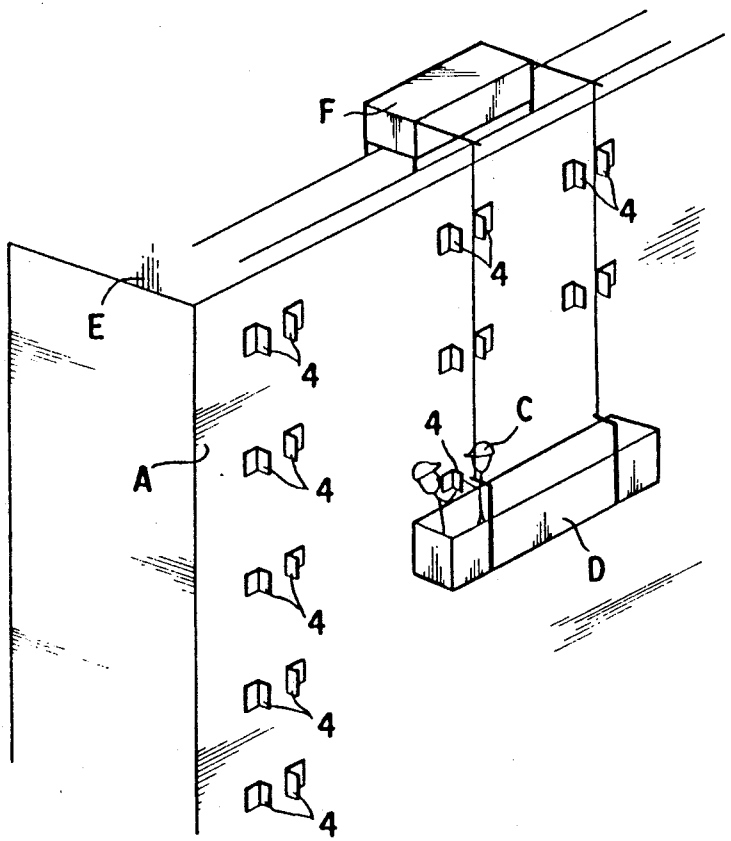
Figure 1:
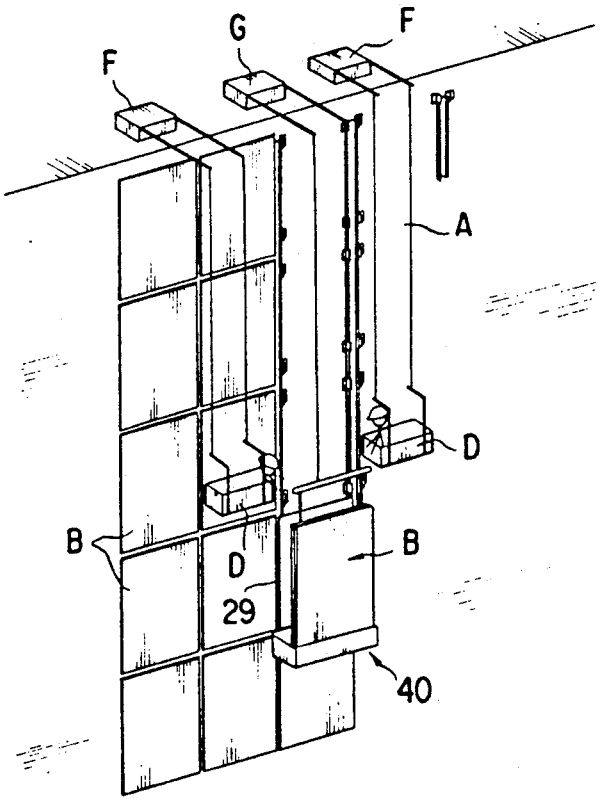
Figure 1D:
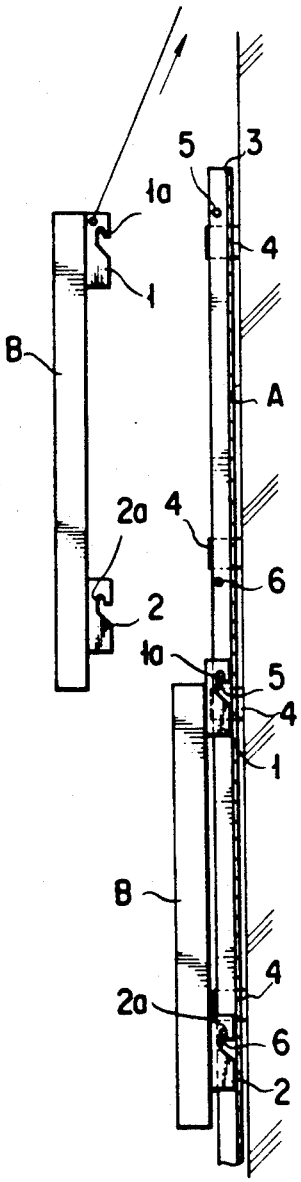
Figure 1E:
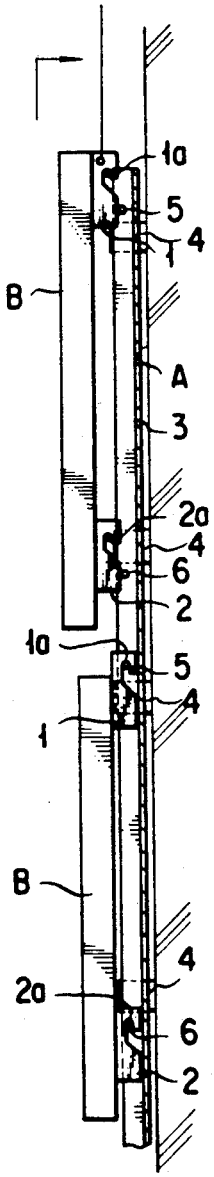
Figure 1F:
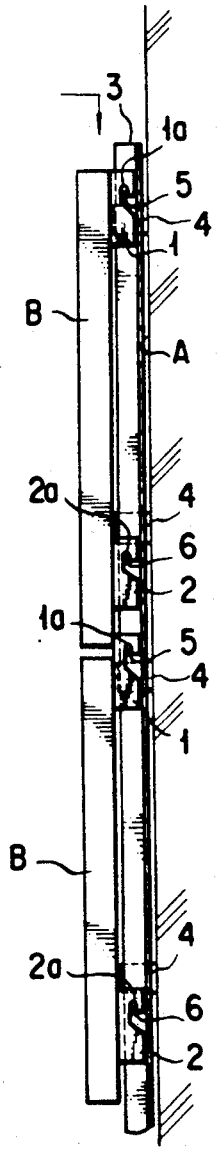

Hereinbelow, preferred embodiments of the present invention will be described in detail with reference to the accompanying drawings in which: the reference character "A" denotes an exterior wall of a building; "B" a panel element; and the reference numeral 1 denotes an upper hook; 2 a lower hook; 5 an upper lateral member; 6 a lower lateral member; 29 a joint space formed between the panel elements "B" which have been mounted on the exterior wall "A" of the building; 40 a lifting-guide unit; 53 a lifting roller employed in the lifting-guide unit 40; and 54 a pilot roller employed in the lifting-guide unit 40.

Figure 2:
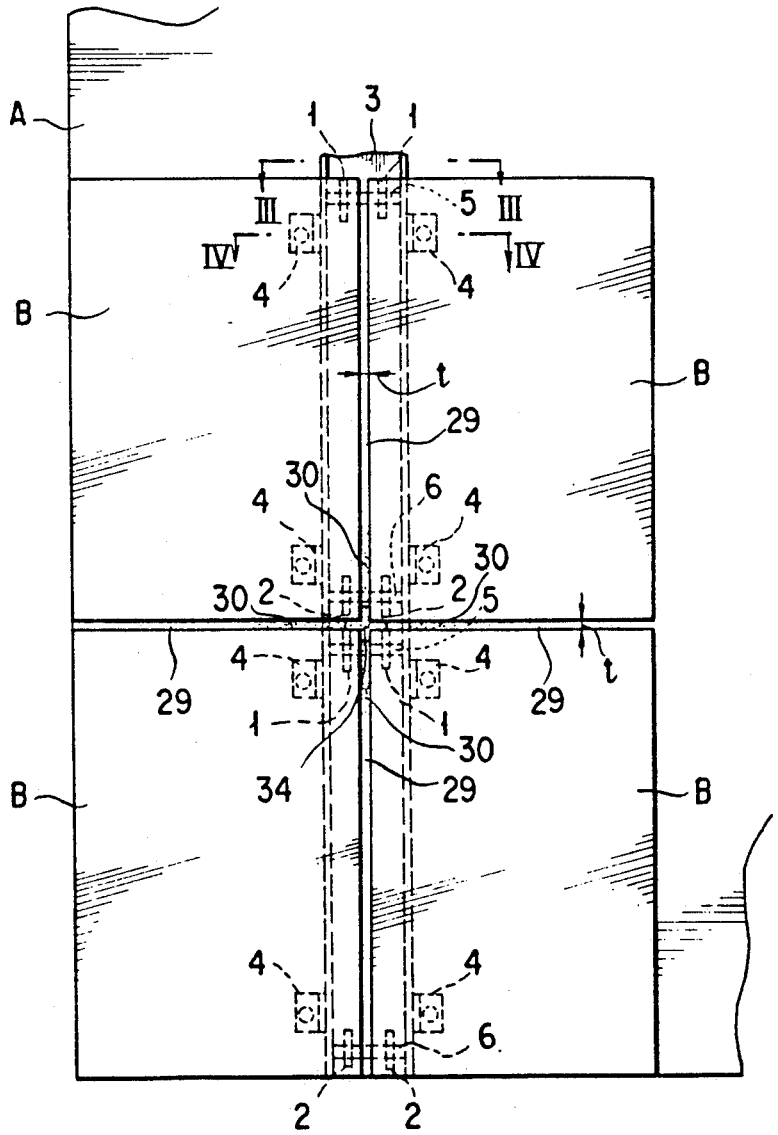
FIG. 2 is a front view of the panel elements mounted on the exterior wall of the building.

As shown in FIG. 2, a plurality of the panel elements "B" are so mounted on the exterior wall "A" of the building as to be spaced apart from each other in parallel relation in both of a vertical and a horizontal direction to form a clearance "t" therebetween.

Namely, a shown in FIGS. 1 (*d*) and 2, a pair of upper hooks 1 are fixedly mounted on opposite ends of an upper portion of a back surface of the panel element "B", while a pair of lower hooks 2 are fixedly mounted on opposite ends of a lower portion of the back surface of the panel element "B".

On the other hand, a vertical mounting member 3 is fixedly mounted on the exterior wall "A" of the building through a plurality of fasteners 4 in such a manner as to span the vertical clearance "t" formed between the panel elements "B" adjacent to each other widthwise. On the vertical mounting member 3 are fixedly mounted an upper lateral member 5 and a lower lateral member 6 which correspond to the upper hooks 1 and the lower hooks 2, respectively, so that the upper hooks 1 engage with the upper lateral member 5 and the lower hooks 2 engage with the lower lateral member 6, whereby the panel element "B" is fixedly mounted on the exterior wall "A" of the building.

Figure 3:
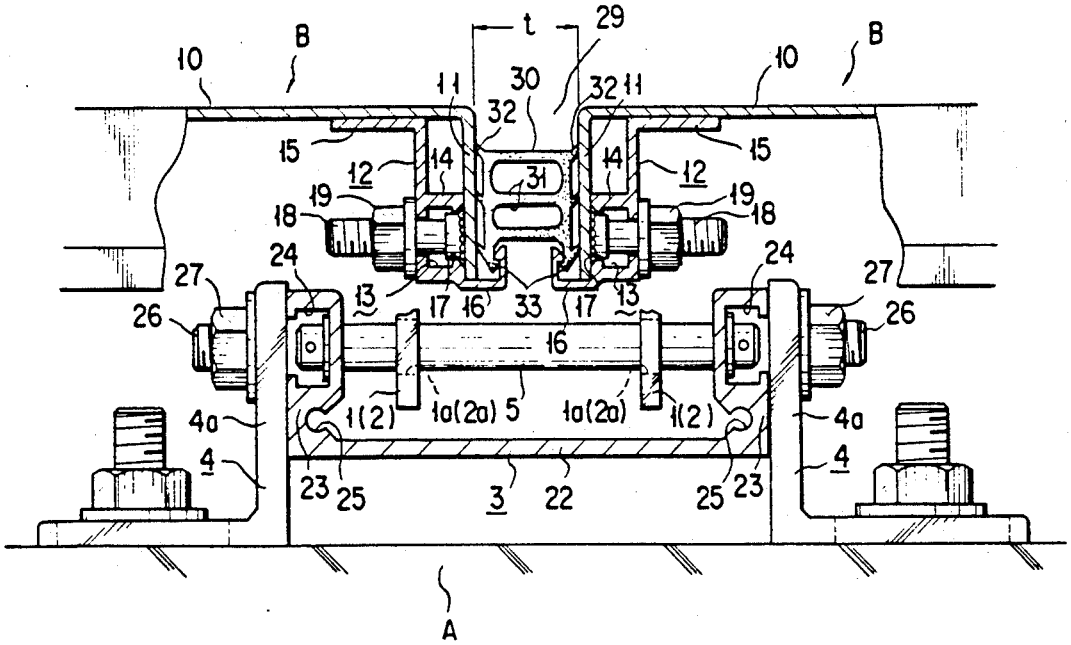
FIG. 3 is a cross-sectional view of portions of the panel elements, taken along the line III—III of FIG. 2.

More specifically, as shown in FIG. 3, the panel element "B" is constructed of: a plate member 10 formed of an aluminum plate or the like, the plate member 10 being bent by an angle of 90° at its vertical opposite ends to form a pair of opposite bent portions 11; and a pair of edge members 12 each of which is fixedly mounted on each of the bent portions 11 of the plate member 10. The edge member 12 is provided with a main body portion 14 in which are integrally formed a concave cavity 13 and a hook-like mounting segment 15 constituting an upper part of the edge member 12 as viewed from FIG. 3. In addition, a supporting segment 16 is integrally formed with a lower part of the main body portion 14 of the edge member 12, as viewed from FIG. 3. A through-hole 17 is formed in the bottom of the main body portion 14 of the edge member 12, in which through-hole 17 is inserted a stud bolt 18 which have been fixed to a back surface of the bent portion 11 of the plate member 10. After insertion of the stud bolt 18 into the through-hole 17, the stud bolt 18 is threadably engaged with a nut 19 and a suitable washer so that the edge member 12 is fixedly mounted on the bent portion 11 of the plate member 10.

Figure 4:
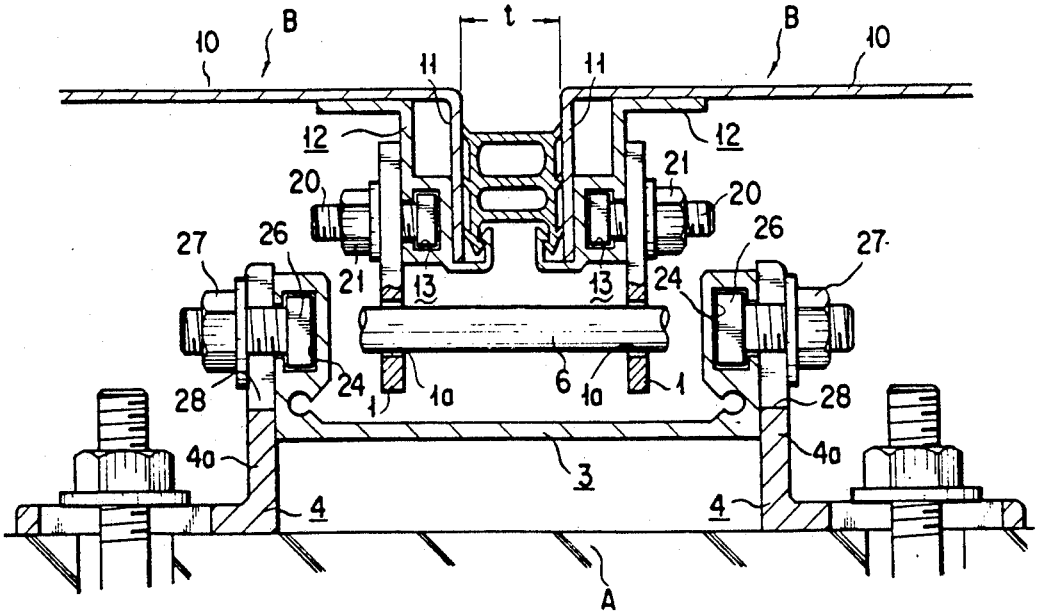
FIG. 4 is a cross-sectional view of portions of the panel elements, taken along the line IV—IV of FIG. 2.

As is clear from FIG. 1 (*d*), each of the upper hooks 1 and the lower hooks 2 of the panel element "B" is of a plate-like shape. The upper hook 1 of the panel element "B" is provided with a concave portion 1*a* which opens downward. Likewise, the lower hook 2 of the panel element "B" is also provided with a concave portion 2*a* opening downward. As shown in FIG. 4, each of the hooks 1, 2 is fixedly mounted on the main body portion 14 of the edge member 12 by a bolt 20 and a nut 21, the bolt 20 being inserted into the concave cavity 13 of the main body portion 14 of the edge member 12. On the other hand, the vertical mounting member 3 is provided with a base-plate portion 22 and opposite-side plate portions 23 to assume a substantially U-shaped form as viewed from FIG. 3. Each of the opposite-side plate portions 23 of the vertical mounting member 3 is provided with a vertical groove 24 which opens sidewardly. In addition, each of the inner corners of the vertical mounting member 3 is formed into a substantially rounded groove corner 25 as shown in FIG. 3. On the other hand, a fastener 4 is provided with a side segment portion 4*a*, while fixedly mounted on the exterior wall "A" of the building. The side segment portion 4*a* of the fastener 4 extends in a direction perpendicular to the exterior wall "A" of the building. As shown in FIG. 4, the vertical mounting member 3 is fixedly mounted on the fasteners 4 through a plurality of bolts 26 and nuts 27, the bolts 26 having been inserted into the concave cavities 24 of the vertical mounting member 3. Incidentally, as is clear from FIG. 4, the side segment portion 4*a* of the fastener 4 is provided with an open groove 28 in which the bolt 26 is inserted. During the mounting operation of the vertical mounting member 3 on the fasteners 4, the bolts 26 are slidably inserted into the concave cavities 24 of the vertical mounting member 3, and then slidably inserted into the open grooves 28 of the fasteners 4 to enable the vertical mounting member 3 to span a space between the fasteners 4. After that, the bolts 26 and the nuts 27 are fastened to fixedly mount the vertical mounting member 3 on the fasteners 4.

On the other hand, as shown in FIG. 3, each of the upper lateral members 5 and the lower lateral members 6 spans a space between the opposite-side plate portions 23 of the vertical mounting member 3, and opposite end portions of each of the upper lateral members 5 and the lower lateral members 6 are fixedly mounted in grooves 24 formed in the opposite-side plate portions 23 of the vertical mounting member 3.

As shown in FIG. 3, the bent portions 11 of the plate members 10 of the panel elements "B" adjacent to each other are oppositely disposed from each other by a clearance "t" which defines the joint space 29 in which is press-fitted a joint gasket 30.

As is clear from FIG. 3, the joint gasket 30 is provided with: a plurality of hollow portions 31; a plurality of tongue portions 32 provided in opposite sides of the joint gasket 30; and a pair of projections 33 oriented toward the exterior wall "A" of the building. The pair of the projections 33 of the joint gasket 30 engage with the supporting segments 16 of the edge members 12.

Incidentally, as shown in FIG. 2, a cross-joint gasket 34 which is connected with both of the vertical and the horizontal joint gasket 30 is press-fitted in a cross portion of the clearances "t" defined between the panel elements "B" adjacent to each other.

Now, lifting and guiding operation of the panel elements "B" will be described in detail.

As shown in FIG. 1 (*a*), the fasteners 4 on each pair of the fasteners 4 are horizontally spaced apart f.om each other by a predetermined distance and are fixedly mounted on the exterior wall "A" of the building so as to be arranged in a pair of vertical rows. In each of the vertical rows, the fasteners 4 vertically adjacent to each other are vertically spaced apart from each other so as to substantially correspond to a longitudinal length of the panel element "B". The thus spaced fasteners 4 are fixedly mounted on the exterior wall "A" of the building by the building workers "C" carried by a gondola "D".

Incidentally, the gondola "D" is vertically moved by a gondola lifting machine "F" which is mounted on a roof "E" of the building so as to be movable widthwise.

As shown in FIG. 1 (*b*), the vertical mounting member 3 is interposed between two rows of the fasteners 4, and fixed thereto by the building workers "C" carried by the gondola "D".

Incidentally, since the vertical mounting member 3 has a predetermined length which is generally shorter than the entire length of the exterior wall "A" of the building, it is necessary to employ a plurality of vertical mounting members 3 to cover the entire exterior wall "A". Consequently, during mounting of the vertical mounting members 3 on the exterior wall "A", the vertical mounting members 3 which are vertically adjacent to each other are connected with each other through a pair of connecting pins, each of which is inserted into the rounded groove corners 25 of both of the vertically adjacent vertical mounting members 3 on which the upper lateral members 5 and the lower lateral members 6 have been fixedly mounted.

As described above, since the upper lateral members 5 and the lower lateral members 6 for supporting the panel elements "B" are fixedly mounted on the exterior wall "A" of the building through the vertical mounting members 3 and the fasteners 4, but are not directly mounted on the exterior wall "A", it is possible to precisely position the upper lateral members 5 and the lower lateral members 6 at predetermined locations even when the exterior wall "A" of the building is provided with some projections and cavities, i.e. is irregular.

As shown in FIG. 1 (*c*), the panel element "B" to which the upper hooks 1 and the lower hooks 2 have been fixed in such a manner as illustrated in FIGS. 3 and 4 is mounted on the lifting-guide unit 40. After that, the lifting-guide unit 40 is lifted along the exterior wall "A" of the building, while guided by the joint space 29 formed between the panel elements "B" which have been fixedly mounted on the exterior wall "A" of the building so that the panel element "B" mounted on the lifting-guide unit 40 is vertically lifted by the unit 40 along the joint space 29.

Figure 5:
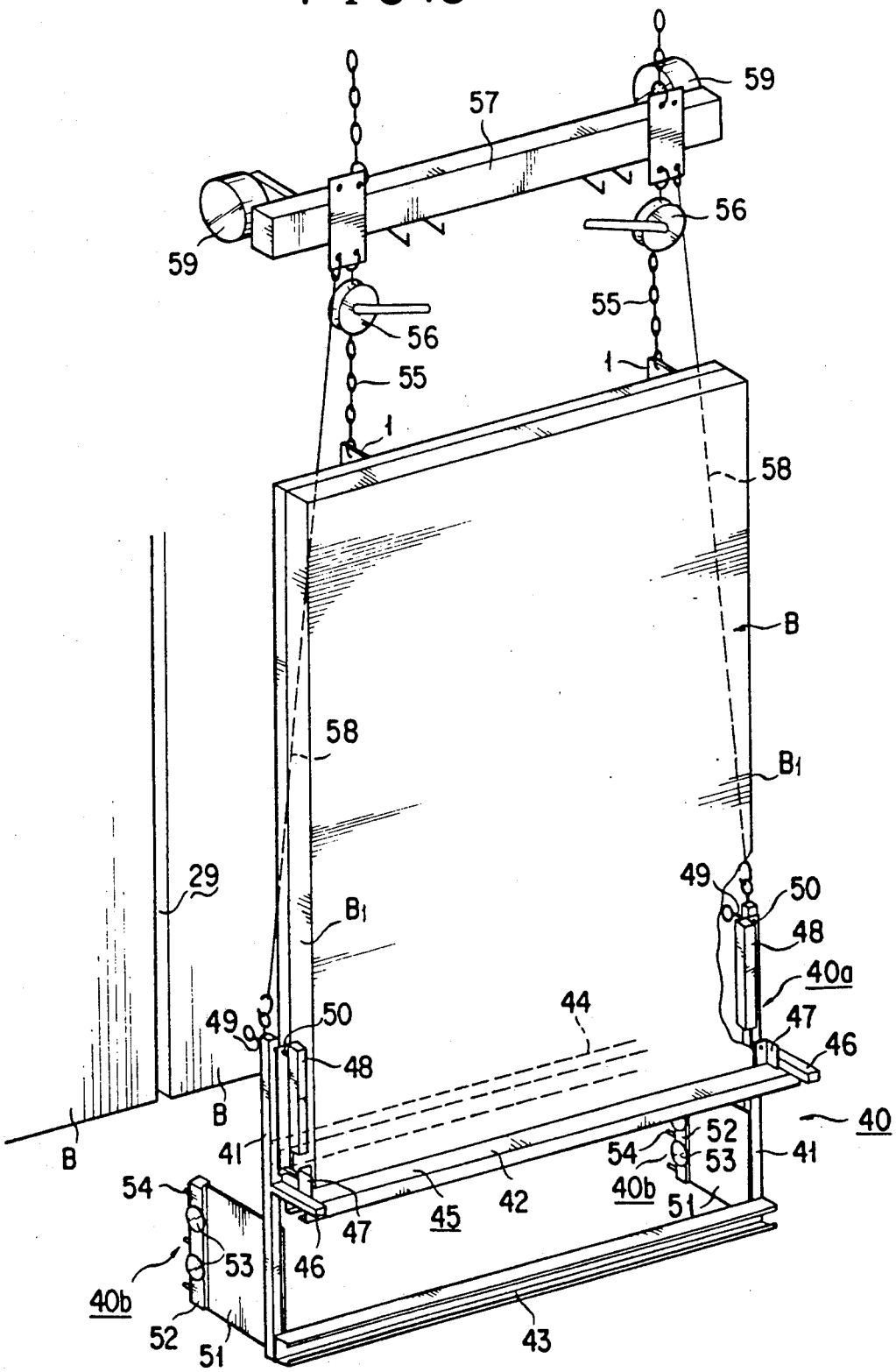
FIG. 5 is a perspective view of the lifting-guide unit employed in the present invention.

As shown in FIG. 5, the lifting-guide unit 40 is provided with a main body portion 40*a* and a pair of opposite guide portions 40*b*.

In the main body portion 40*a* of the lifting-guide unit 40, an intermediate lateral member 42 and a lower lateral member 43 are interposed between a pair of opposite vertical members 41. Oppositely disposed from the intermediate lateral member 42 is a supporting lateral member 44 which cooperates with the intermediate lateral member 42 to form a panel element supporting portion 45 of the lifting-guide unit 40. The intermediate lateral member 42 is supported by a pair of opposite lateral projections 46 of the opposite vertical members 41. Each of the opposite lateral projections 46 is provided with a bracket 47 on which a holding member 48 is mounted so as to be rotatable in a horizontal plane. A locking pin 49 is provided in an upper portion of each of the vertical members 41, while a locking hole 50 is provided in each of the holding members 48. During mounting of the panel element "B" on the lifting-guide unit 40, after the panel element "B" is put on the lifting-guide unit 40, the holding members 48 are horizontally rotated to abut on opposite end portions "$B_1$" of a front surface of the panel element "B", and then the locking pins 49 of the vertical members 41 are so actuated as to enter the locking holes 50 of the holding members 48 under the influence of springs (not shown), so that the panel element "B" is firmly held in a vertical position in the lifting-guide unit 40.

Figure 6:
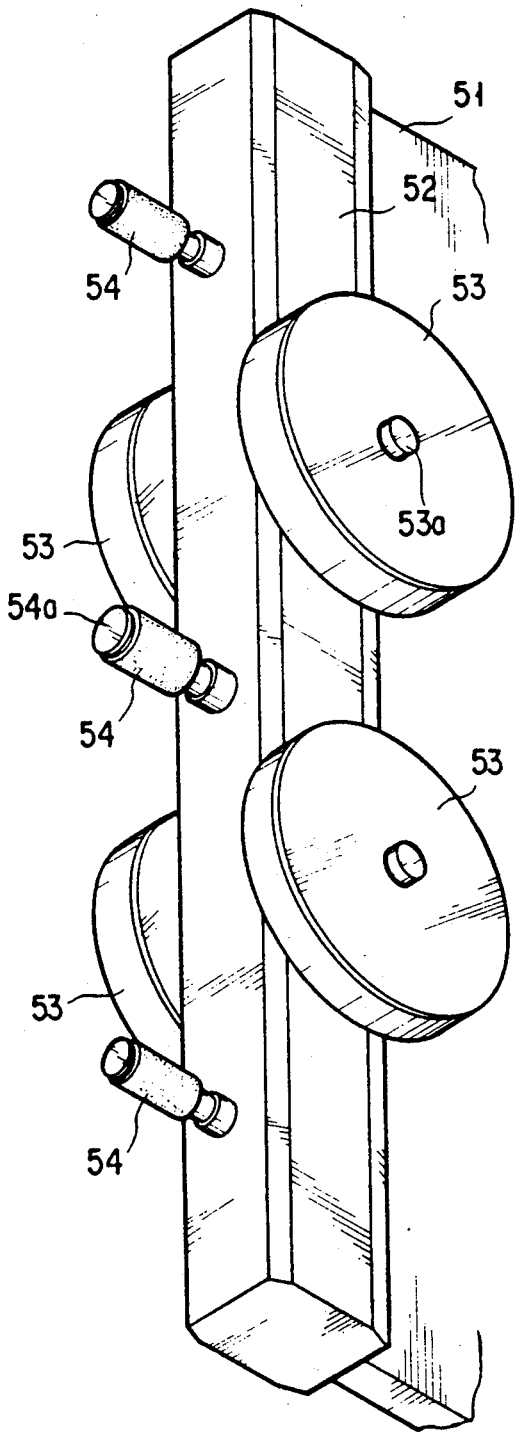
FIG. 6 is an enlarged perspective view of the guide portion of the lifting-guide unit shown in FIG. 5.

On the other hand, as shown in FIG. 5, in the opposite guide portions 40*b* of the lifting-guide unit 40, a vertical plate 51 is fixed to each of the vertical members 41, to which vertical plate 51 is fixed a mounting post 52 on which are rotatably mounted the lifting rollers 53 and the pilot rollers 54. More specifically, as viewed from FIG. 6, the lifting rollers 53 are mounted on opposite sides of the mounting post 52 so as to be arranged in rows. A supporting axle 53*a* of the lifting roller 53 horizontally extends in a direction perpendicular to the vertical member 41. An outer peripheral surface of the lifting roller 53 is covered with a rubber member so that the lifting roller 53 constitutes a rubber roller. On the other hand, as viewed from FIG. 6, the pilot rollers 54 are rotatably mounted on an upper portion, an intermediate portion and a lower portion of a front surface of the mounting post 52. A supporting axle 54*a* of the pilot roller 54 horizontally extends outward from the front surface of the mounting post 52 in a direction perpendicular to the front surface of the mounting post 52. The pilot roller 54 has an outer diameter slightly smaller than the clearance "t". More specifically, as viewed from FIG. 6, each of the pilot rollers 54 mounted on the upper and the lower portion of the front surface of the mounting post 52 is slightly smaller in outer diameter than the pilot roller 54 mounted on the intermediate portion of the front surface of the mounting post 52, and thereby enters the joint space 29 more easily than the intermediate pilot roller 54.

As shown in FIG. 5, the upper hooks 1 of the panel element "B" mounted on the lifting-guide unit 40 are connected with a lifting beam 57 through a chain 55 and a lever chain block 56, while the opposite vertical members 41 of the lifting-guide unit 40 are connected with opposite sides of the lifting beam 57 through lifting-guide suspension ropes 58. The lifting beam 57 is vertically moved by the lifting-guide unit hoist "G", and is provided with a pair of guide rollers 59.

Consequently, during mounting of the panel element "B" on the lifting-guide unit 40 having the above construction, first of all, the locking pins 49 of the opposite vertical members 41 are drawn from the locking holes 50 of the holding members 48 to permit the holding members 48 to rotate outward. Under such circumstances, the panel element "B" is so put on the intermediate lateral member 42 as to abut on the supporting lateral member 44. After that, the holding members 48 are rotated inward to abut on the opposite side portions $B_1$ of the panel element "B", and then the locking pins 49 of the vertical members 41 are inserted into the locking holes 50 of the holding members 48 so that the panel element "B" is firmly mounted on the main body portion 40*a* of the lifting-guide unit 40. The upper hooks 1 of the thus mounted panel element "B" are then connected with the lifting beam 57. On the other hand, the pilot rollers 54 of the lifting-guide unit 40 are inserted into the joint space 29 of the panel elements "B" which have been mounted on the exterior wall "A" of the building. The lifting rollers 53 of the lifting-guide unit 40 abut on the panel elements "B" which have been mounted on the exterior wall "A", to prevent the main body portion 40*a* of the unit 40 from interfering with the panel elements "B" that have been mounted on the exterior wall "A" of the building. The pilot rollers 54 guide the lifting-guide unit 40 vertically along the joint space 29 to stabilize the unit 40 widthwise during the lifting operation thereof.

As shown in FIG. 1 (*d*), when the panel element "B" mounted on the lifting-guide unit 40 reaches a position above the top one of the panel elements "B" which have been mounted on the exterior wall "A" of the building, the panel element "B" mounted on the unit 40 is disengaged from the unit 40 and drawn toward the exterior wall "A". After that, as shown in FIG. 1 (*e*), the upper hooks 1 and the lower hooks 2 of the panel element "B" thus disengaged abut on the upper lateral member 5 and the lower lateral member 6, respectively.

Under such circumstances, the lever chain blocks 56 unwind the chains 55 to vertically move the panel element downward to cause the upper hooks 1 and the lower hooks 2 to receive the upper lateral member 5 and the lower lateral member 6 in their concave portions 1*a* and 2*a*, respectively, whereby the panel element "B" thus disengaged from the lifting-guide unit 40 is fixedly mounted on the exterior wall "A" of the building.

Figure 7:
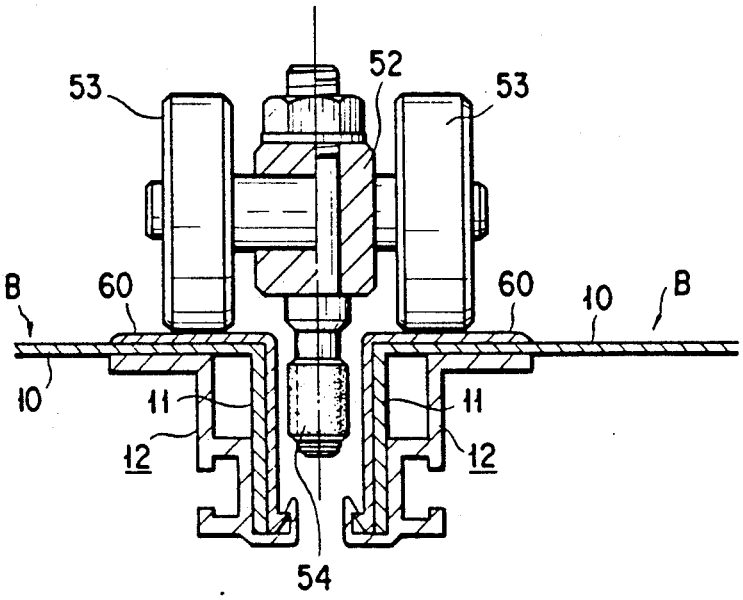
FIG. 7 is a cross-sectional view of the guide portion of the lifting-guide unit shown in FIG. 5, during a lifting operation.

As described above, during the lifting and guiding operation of the panel element "B", since the lifting-guide unit 40 is lifted along the panel elements "B" that have been mounted on the exterior wall "A" to cause the lifting rollers 53 and the pilot rollers 54 to rotatably move along surfaces of the panel elements "B", there is a fear that these rollers 53, 54 may damage the surfaces of the panel elements "B" which have been mounted on the exterior wall "A" of the building. As shown in FIG. 7, in order to prevent the panel elements "B" from being damaged by these rollers 53, 54 of the lifting-guide unit 40 in a lifting and guiding operation thereof, a pair of cured sheets 60 of synthetic resin or a pair of aluminum sheets are employed to cover the plate members 10 and their bent segments 11. As is clear from FIG. 7, the cured sheets 60 prevent the surfaces of the panel elements "B" mounted on the exterior wall "A" of the building from being damaged by the rollers 53, 54 of the lifting-guide unit 40. After completion of mounting operations of the panel elements "B" on the exterior wall "A" of the building, the cured sheets 60 are removed from the panel elements "B", and the joint gaskets 30 are press-fitted in the joint spaces 29 formed between the panel elements "B" mounted on the exterior wall "A" of the building.

Figure 8:
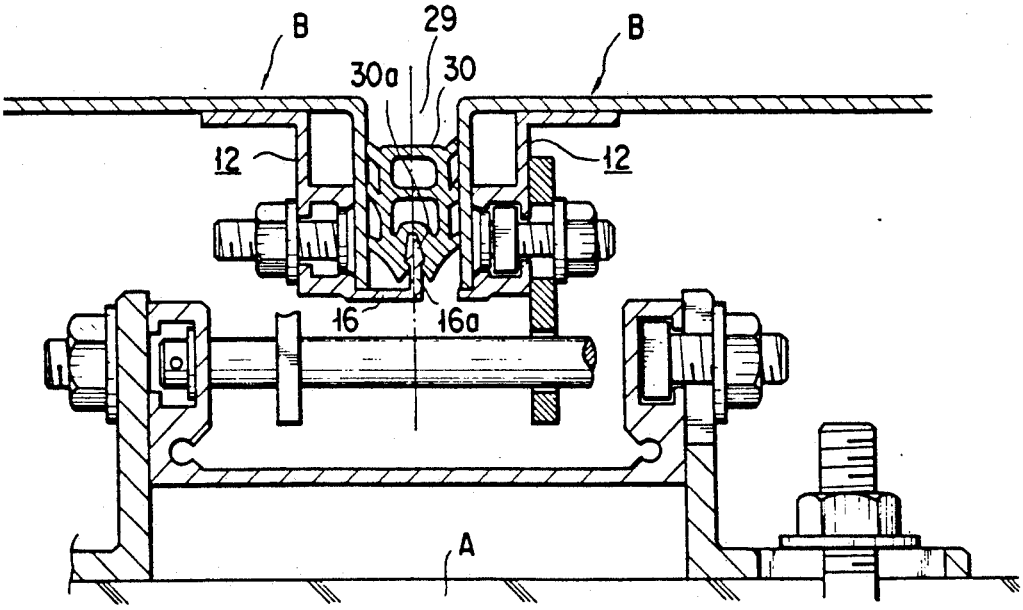
FIG. 8 is a cross-sectional view of a joint gasket press-fitted into the joint space formed between the panel elements.
Figure 9:
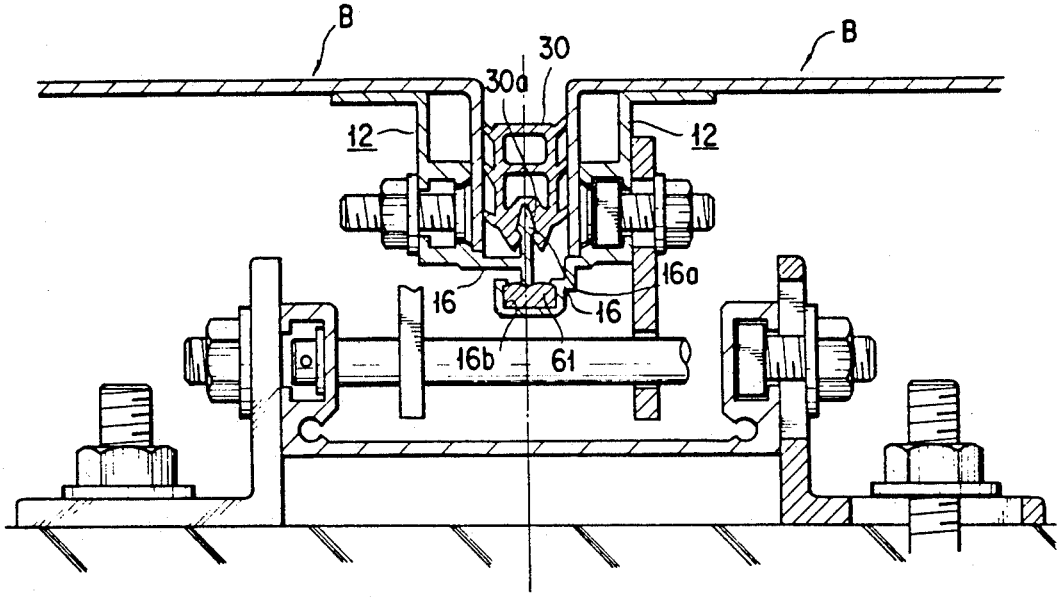
FIG. 9 is a cross-sectional view of another joint gasket press-fitted into the joint space formed between the panel elements.

In one of the edge members 12 such as the right one of the edge members 12 as viewed from FIG. 8, it is also possible to eliminate the supporting segment 16 of the edge member 12. In this case, the left one of the edge members 12 has an engaging projection 16*a* of its supporting segment 16 inserted into an engaging groove 30*a* of the joint gasket 30 as shown in FIG. 8. In addition, as shown in FIG. 9, it is also possible for the right one of the edge members 12 as viewed from FIG. 9 to have a concave groove 16*b* in its supporting segment 16. In this case, an additional gasket 61 is press-fitted in the concave groove 16*b* of the supporting segment 16 of the right edge member 12 as viewed from FIG. 9, while brought into a close contact with an additional engaging projection of the supporting segment 16 of the left edge member 12, which additional engaging projection extends in a direction counter to the extending direction of the engaging projection 16*a*. As a result, as shown in FIG. 9, the joint space 29 formed between the panel elements "B" is double-sealed by the joint gasket 30 and the additional gasket 61.

Figure 10:
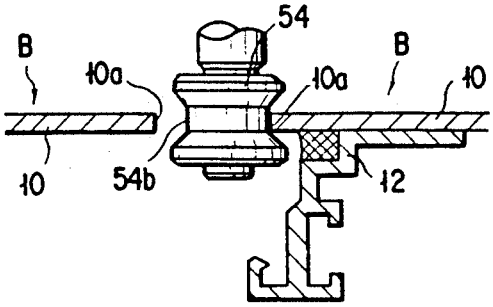
FIG. 10 is a front view of a modification of the pilot roller employed in the guide portion of the lifting-guide unit shown in FIG. 5.

On the other hand, as shown in FIG. 10, it is also possible for the plate member 10 of the panel element "B" to have its edge portion 10*a* extend widthwise beyond the edge member 12. In this case, the pilot roller 54 is so modified as to have an intermediate small-diameter portion 54*b* which is brought into contact with the edge portion 10*a* of the plate member 10 of the panel element "B" to stabilize the lifting-guide unit 40 in its lifting and guiding operation, whereby the unit 40 is prevented from vibrating in a direction perpendicular to the exterior wall "A" of the building.

In the method and apparatus of the present invention having the above constructions, since the panel element "B" is lifted by the lifting-guide unit 40 which travels on the line of the joint space 29 formed between the panel elements "B" which have been mounted on the exterior wall "A" of the building, it is not necessary for the panel element "B" to assume a specialized shape. In addition, it is also possible for the panel element "B" to have a flat front surface which provides the exterior wall "A" of the building with an improved appearance.

In addition, according to the present invention, since the upper hooks 1 and the lower hooks 2 of the panel element "B" engage with the upper lateral lever 5 and the lower lateral lever 6 respectively to fixedly mount the panel element "B" on the exterior wall "A" of the building, it is possible to fixedly mount the panel element "B" on the exterior wall "A" of the building in a simple manner.

Since the lifting-guide unit 40 is provided with the opposite guide portions 40*b* having the pilot rollers 54 received in the joint space 29, it is possible to prevent the unit 40 from vibrating laterally during the lifting and guiding operation.

Since the above description refers to the preferred embodiments only, it should be understood that those skilled in the art could accomplish modifications within the scope of the present invention and accordingly, the present invention should be measured from the following claims.

What is claimed is:

1. A method for mounting a plurality of panel elements on an upper and a lower lateral member mounted on an exterior wall of a building so as to correspond to each of said panel elements; an upper hook being mounted on a back surface of each of said panel elements for engagement with said upper lateral members and a lower hook being mounted on a back surface of each of said panel elements for engagement with said lower lateral members comprising the steps of:

sequentially mounting said panel elements from a bottom of said building in such a manner as to permit said upper and said lower hook of each of said panel elements to engage said upper and said lower lateral member of said exterior wall of said building, respectively, so that said panel elements are mounted first at a lower portion of the building, said panels being mounted spaced from one another in a lateral direction to define a vertical joint space therebetween, said sequentially mounting step comprising the substeps of:

lifting said panel elements to mounting locations above said lower portion of the building by a lifting-guide unit; and employing said joint spaces for guiding said lifting-guide unit up the building while lifting said panel elements by extending a guide element into said joint spaces

2. A method for mounting building panels onto a building, comprising the steps of:

mounting first building panels on a lower portion of a side of the building spaced from one another to define joint spaces between said first building panels, said joint spaces extending vertically along the side of the building and substantially parallel to one another;

guiding second building panels up the side of the building along said joint spaces between said first building panels, including the substeps of:

extending a guide member into said joint spaces, said guide member being movable along said joint spaces;

rolling guide rollers along exterior surfaces of said first building panels on either side of said joint spaces as said second building panels are guided up the building; and hooking said second building panels onto lateral members on the building above said first building panels.

* * * * *